US010590659B2

(12) United States Patent
Santarossa et al.

(10) Patent No.: US 10,590,659 B2
(45) Date of Patent: Mar. 17, 2020

(54) PRE-FINISHED INSULATED PANEL SYSTEM FOR CLADDING A BUILDING

(71) Applicant: CANAROCK LIMITED, Woodbridge (CA)

(72) Inventors: Ned Santarossa, Woodbridge (CA); Gary Campacci, Woodbridge (CA)

(73) Assignee: 888804 ONTARIO LIMITED, Woodbridge, Ontario (CA)

( * ) Notice: Subject to any disclaimer, the term of this patent is extended or adjusted under 35 U.S.C. 154(b) by 0 days.

(21) Appl. No.: 15/945,811

(22) Filed: Apr. 5, 2018

(65) Prior Publication Data

US 2019/0309525 A1 Oct. 10, 2019

(51) Int. Cl.

*E04F 13/08* (2006.01)
*E04F 13/073* (2006.01)
*E04F 19/02* (2006.01)

(52) U.S. Cl.

CPC ..... *E04F 13/0876* (2013.01); *E04F 13/0733* (2013.01); *E04F 13/0846* (2013.01); *E04F 13/0894* (2013.01); *E04F 19/02* (2013.01); *E04F 13/0885* (2013.01); *E04F 2201/023* (2013.01)

(58) Field of Classification Search

CPC ..... E04F 13/0733; E04F 13/0846; E04F 13/0878; E04F 13/0885; E04F 13/0889; E04F 13/0894; E04F 19/02; E04F 2201/023; E04C 2/292

USPC ..... 52/58

See application file for complete search history.

(56) References Cited

U.S. PATENT DOCUMENTS 1,909,625 A * 5/1933 Meier ..... E04F 13/0803 52/385
2,023,452 A * 12/1935 Voegeli ..... E04C 2/292 52/378
2,961,804 A * 11/1960 Beckman ..... E04C 2/26 52/539
3,131,513 A * 5/1964 Grigas ..... E04F 13/0803 52/520

(Continued)

FOREIGN PATENT DOCUMENTS

CN 205557872 U 9/2016
DE 202007017751 U1 5/2009
DE 202017106824 U1 * 12/2017 ..... E04F 13/0826

*Primary Examiner* — Patrick J Maestri
*Assistant Examiner* — Joseph J. Sadlon
(74) *Attorney, Agent, or Firm* — Norton Rose Fulbright Canada LLP

(57) ABSTRACT

A pre-finished insulated panel system for cladding an exterior wall of a building, the system comprising: rectangular panels each with an insulation core and weather resistant coating defining a central portion with a panel thickness between an inside mounting surface and an exposed outside surface, the plurality of panels adapted for engagement in a series of parallel rows; each panel having: a mounting flange disposed on the top edge and on a first lateral edge of each panel, the mounting flange including: a recessed mounting groove; an inner ridge; and an outer ridge; an elongate cover flange complementary with the mounting flange disposed on the bottom edge and on an opposing second lateral edge, the cover flange including: an inner groove complementary to the inner ridge; and an outer groove complementary to the outer ridge; and mechanical fasteners within the recessed mounting groove and anchoring to the wall.

16 Claims, 17 Drawing Sheets

(56) References Cited

U.S. PATENT DOCUMENTS 3,714,747 A * 2/1973 Curran ..... E04B 2/56 52/309.2
4,299,069 A 11/1981 Neumann
4,316,351 A * 2/1982 Ting ..... E04C 2/292 52/309.9
4,372,901 A * 2/1983 Kim ..... B29C 44/18 264/261
4,551,958 A * 11/1985 Reneault ..... E04F 13/0889 52/309.4
4,586,304 A * 5/1986 Flamand ..... E04F 13/18 52/309.8
4,672,789 A * 6/1987 Fortier ..... E04F 13/0864 52/519
4,767,581 A * 8/1988 Tippmann ..... B23D 1/26 264/156
4,854,845 A * 8/1989 Couderc ..... B29C 35/16 425/363
4,961,295 A * 10/1990 Kosch, Sr. ..... A47F 5/0846 211/94.02
5,029,425 A * 7/1991 Bogataj ..... E04F 13/0803 52/478
5,191,745 A * 3/1993 Story ..... E04F 13/0812 52/127.8
5,277,009 A * 1/1994 Yamaguchi ..... E04F 13/0862 52/387
5,359,824 A * 11/1994 Koberstein ..... E04C 2/428 411/148
5,678,369 A * 10/1997 Ishikawa ..... B32B 3/02 52/309.7
5,749,282 A * 5/1998 Brow ..... E04B 1/6813 52/209
5,987,835 A 11/1999 Santarossa
6,044,609 A * 4/2000 Kim ..... E04F 13/0864 52/551
6,298,626 B2 * 10/2001 Rudden ..... E04C 2/296 52/309.9
6,606,834 B2 8/2003 Martensson et al.
6,968,659 B2 * 11/2005 Boyer ..... E04C 2/292 52/235
6,990,778 B2 * 1/2006 Passeno ..... E04F 13/0862 52/385
7,028,436 B2 * 4/2006 Bezubic, Jr. ..... B28B 1/526 52/288.1
7,908,814 B2 * 3/2011 Wilson ..... E04F 13/0864 52/309.8
8,161,699 B2 * 4/2012 LeBlang ..... E04B 1/165 52/252
8,176,701 B2 5/2012 Cullen
8,511,031 B2 8/2013 Bergelin et al.
8,621,810 B2 * 1/2014 Manser ..... E04B 1/4178 52/235
8,745,952 B2 6/2014 Perra et al.
8,756,892 B2 * 6/2014 Wilson ..... E04F 13/007 52/302.3
8,938,927 B1 * 1/2015 Bragg ..... E04F 13/0803 52/483.1
9,085,908 B2 * 7/2015 Desch nes ..... E04F 13/0803
9,109,363 B2 * 8/2015 Grau ..... E04C 2/30
9,140,010 B2 * 9/2015 Pervan ..... B27N 3/04
9,260,872 B2 * 2/2016 Bunch ..... E04B 1/165 52/252
9,267,280 B2 * 2/2016 Sawatzky ..... E04B 2/46
9,303,398 B2 * 4/2016 Bell ..... B23D 1/26 264/156
9,328,506 B2 5/2016 Gibson
10,087,639 B1 * 10/2018 Simonsen ..... E04F 13/0864 52/309.8
10,253,506 B2 * 4/2019 Culpepper ..... E04F 13/0803 52/478
10,323,420 B2 * 6/2019 Hensiek ..... B29C 35/16 425/363
2006/0185299 A1 8/2006 Poupart
2007/0261353 A1 * 11/2007 Cullen ..... E04F 13/04 52/590.2
2010/0263316 A1 * 10/2010 Bruneau ..... E04F 13/0803 52/546
2017/0009449 A1 1/2017 Leen
2017/0234019 A1 8/2017 Culpepper et al.
2017/0328072 A1 11/2017 Hannig

* cited by examiner

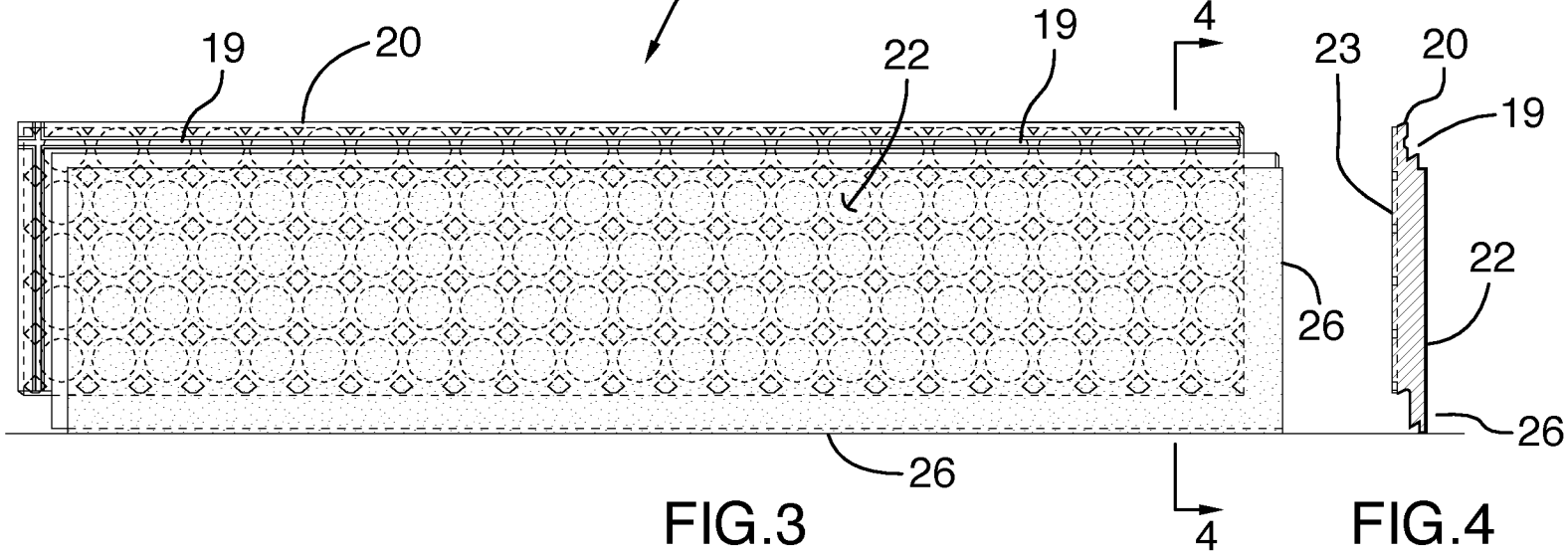
FIG.3
FIG.4
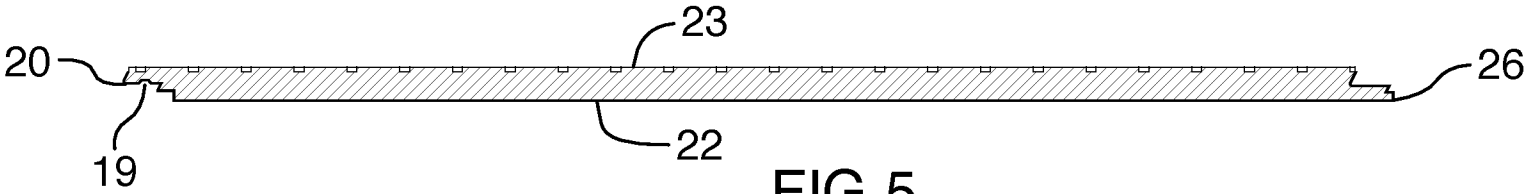
FIG.5

PRE-FINISHED INSULATED PANEL SYSTEM FOR CLADDING A BUILDING

TECHNICAL FIELD

The invention relates to a pre-finished insulated panel system for cladding a building with rectangular panels having interlocking and overlapping joints, and mounted to the building wall with adhesives and mechanical fasteners hidden in the joints.

BACKGROUND OF THE ART

Conventional exterior insulated finishing systems (EIFS) for building construction include insulating foam cores that are cut with a hot wire to a desired profile, externally covered with self-adhering reinforcing mesh and then extrusion coated with various coatings for weatherproofing, visual effects and durability. Final coating may be applied on a building site but in general pre-finished fully manufactured components are preferred due to better quality control, lower cost and consistent finish. Prefinished EIFS components include prefabricated panels and trim components to surround doors and windows.

All EIFS components have an insulating foam core coated with weatherproof coating to provide an externally installed insulated finished wall. The foam core serves to supplement or completely replace internally installed insulation such as spray foam or flexible fibrous insulation batts.

Pre-finished and pre-fabricated EIFS systems have replaced traditional foam insulation boards coated on site with stucco due to cost, quality, and speed of installation. U.S. Pat. No. 5,987,835 and US Patent Publication 2006/0185299 describe examples of EIFS systems using partially or fully pre-finished panels.

Moisture penetration has caused problems with corrosion and other water damage to the underlying building components of the exterior wall covered with an EIFS system. Wind and rain tend to drive moisture through joints and cracks in the EIFS cladding. Moisture barriers are provided between the underlying building substrate and the EIFS cladding. Drainage grooves on the inside surface of EIFS panels drain the trapped moisture and direct water to bleed holes in the base of the EIFS cladding.

It is desirable to produce a pre-finished EIFS cladding system that reduces on-site labour costs, improves quality and reliability.

Features that distinguish the present invention from the background art will be apparent from review of the disclosure, drawings and description of the invention presented below.

DISCLOSURE OF THE INVENTION

The invention provides a pre-finished insulated panel system for cladding an exterior wall of a building, the wall including a supporting structural substrate, the system comprising: a plurality of rectangular panels, wherein each panel has an insulation core and weather resistant coating defining a central portion with a panel thickness between an inside mounting surface and an exposed outside surface, a top edge, a bottom edge, and opposing lateral edges, the plurality of panels adapted for engagement in a series of parallel rows; each panel having: a mounting flange disposed on the top edge and on a first lateral edge of each panel, the mounting flange including: a recessed mounting groove; an inner ridge; and an outer ridge; an elongate cover flange complementary with the mounting flange disposed on the bottom edge and on an opposing second lateral edge, the cover flange including: an inner groove complementary to the inner ridge; and an outer groove complementary to the outer ridge; and mechanical fasteners having a fastener head disposed within the recessed mounting groove and a shank for anchoring in the supporting structural substrate.

DESCRIPTION OF THE DRAWINGS

In order that the invention may be readily understood, one embodiment of the invention is illustrated by way of example in the accompanying drawings.

FIG. 3 shows an exterior elevation view of a wide panel where the top and left edges include mounting flanges and the bottom and right edges include overlapping and interlocking cover flanges.

FIG. 4 shows a section view along line 4-4 of FIG. 3.

FIG. 5 shows a section view along line 5-5 of FIG. 3.

Further details of the invention and its advantages will be apparent from the detailed description included below.

DETAILED DESCRIPTION OF PREFERRED EMBODIMENTS

Figure 1:
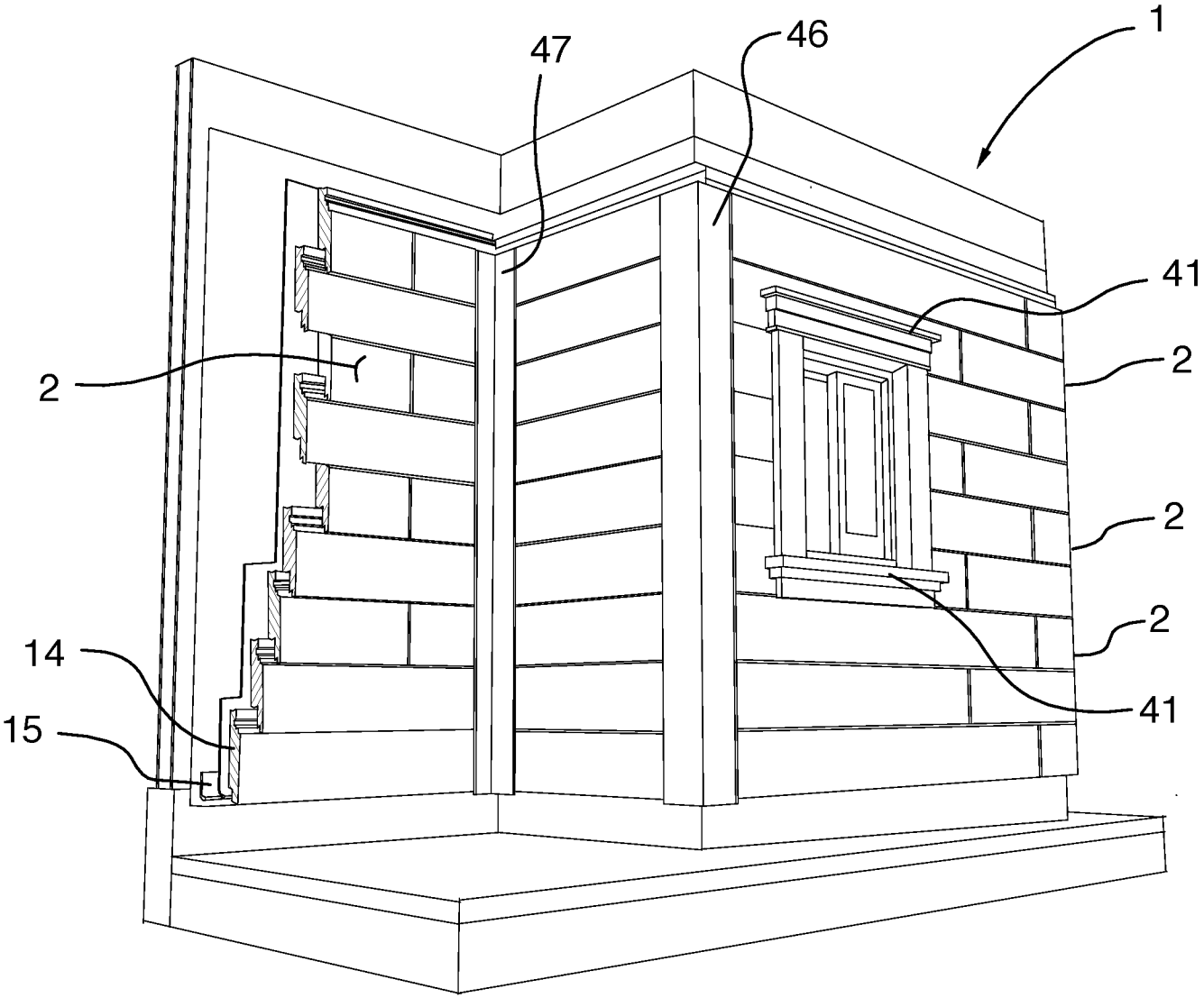
FIG. 1 is a perspective vertical elevation view of a partially installed exterior wall covered with the pre-finished insulated panel system described herein.
Figure 2:
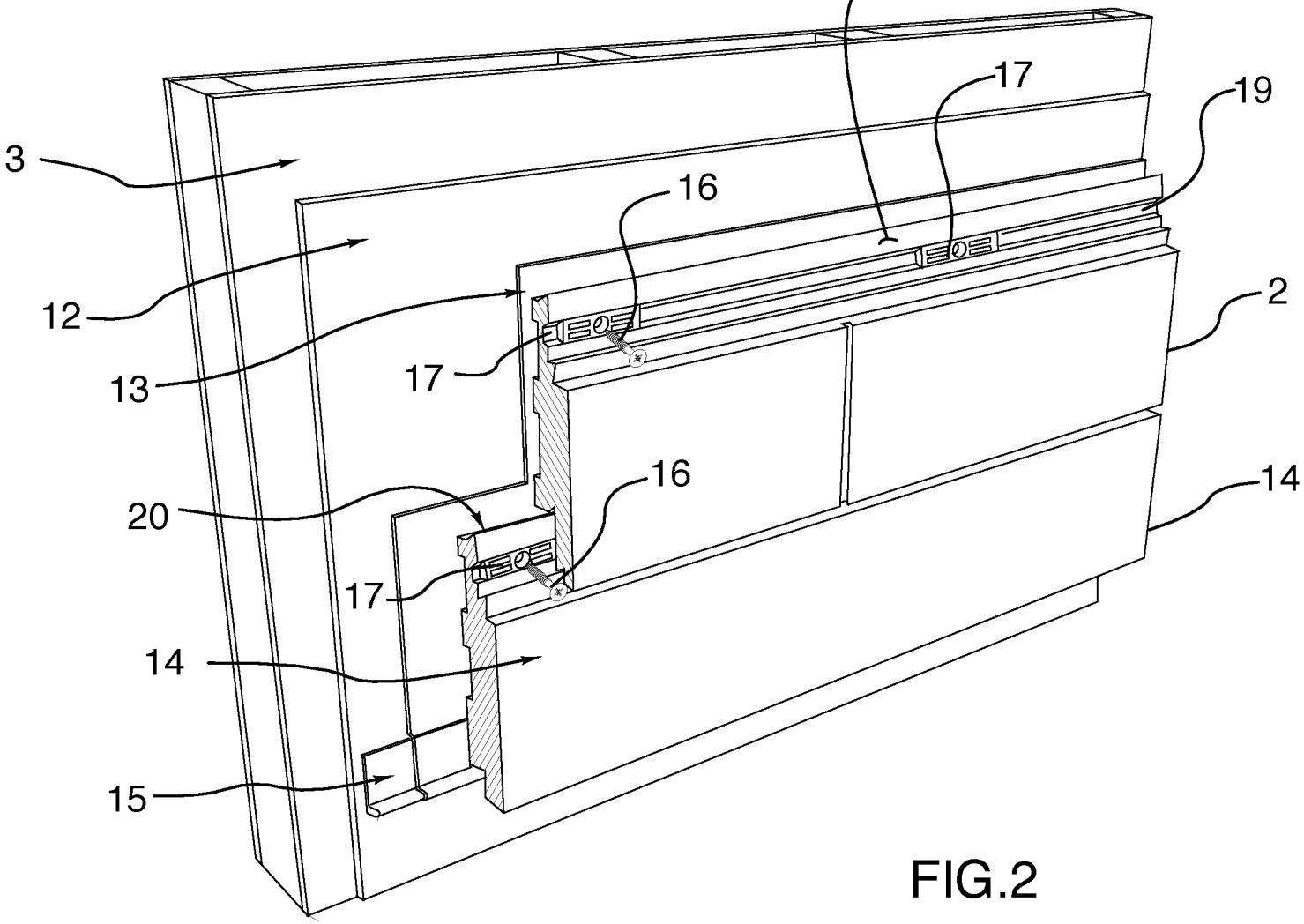
FIG. 2 is a detail view of the bottom two rows of panels of the system, in particular showing the bottom starter flashing strip, bottom row of starter panels with a drip edge, and the second row of regular or intermediate panels installed with screw fasteners and elongate washers to the building wall substrate.
Figure 13:
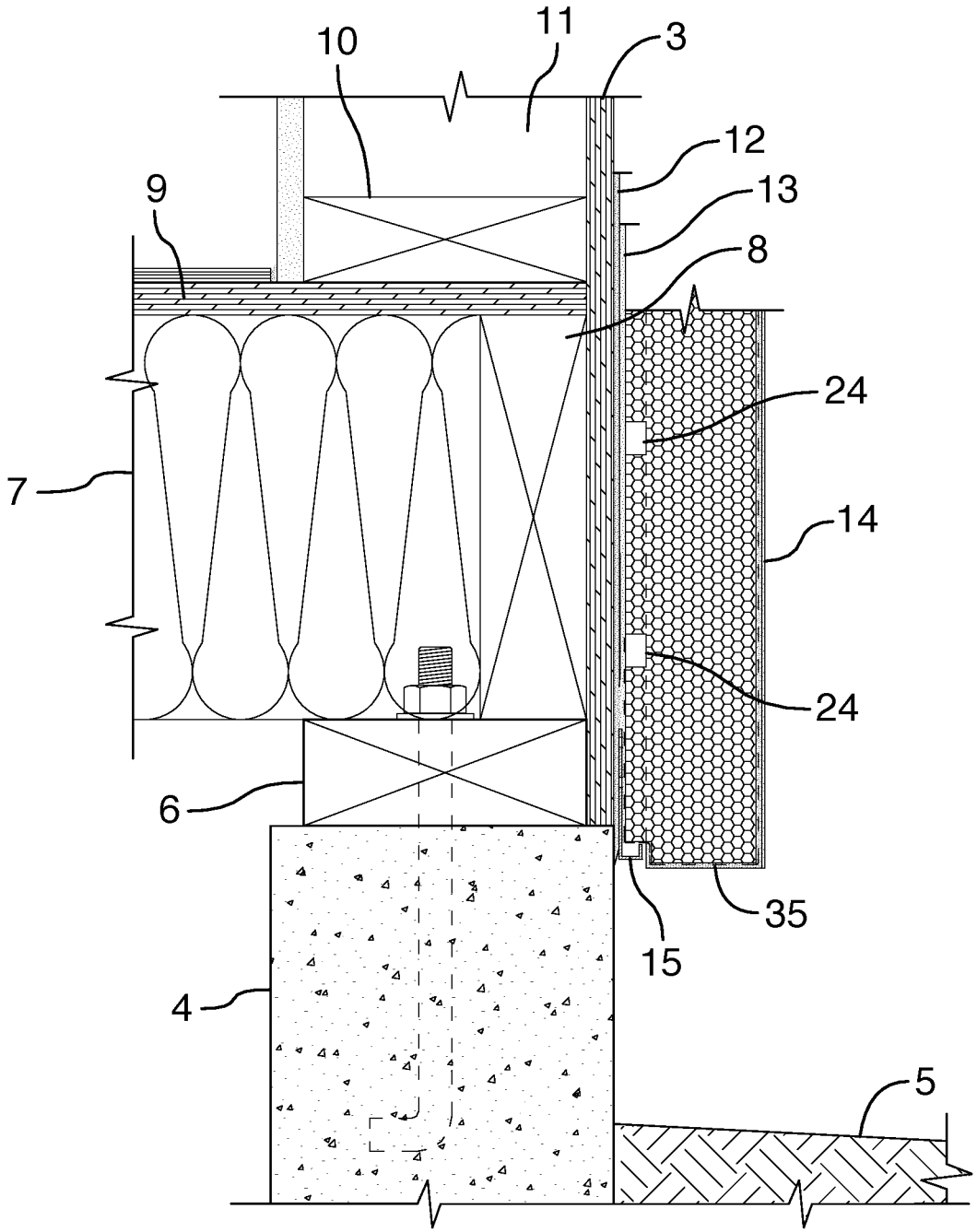
FIG. 13 is a partial vertical sectional view through an example ground level building structure with an exterior wall covered with a starter flashing strip and a starter panel.

FIG. 1 shows a perspective vertical elevation view of an exterior wall 1 partially covered with pre-finished insulated panels 2. FIGS. 2 and 13 show the typical construction of a wood frame building with an exterior supporting structural substrate of oriented strand board 3 but the specific nature of the board 3 and frame structure could be any common type that produces a generally flat vertical wall surface.

Referring to FIG. 13, common wood frame construction used in North America begins with a concrete foundation wall 4 extending above the adjacent ground surface 5. The wood frame building includes a sill plate 6, floor joists 7, a rim joist 8, floor board 9, wall plate 10 and wall stud 11 to support the exterior sheathing board 3.

As seen in FIGS. 2 and 13, to weatherproof the board 3, prevent moisture penetration into the board 3 and drain away any moisture accumulation, the installation of the panel system includes an air-moisture barrier coating 12. An adhesive coating 13 adheres the exterior insulating panel system to the supporting board 3. At the bottom of the starter panel 14, a starter flashing strip 15 made of PVC (polyvinyl chloride plastic) is installed to direct any moisture blocked by the moisture barrier 12 and adhesive 13 downward and outward. The adhesive 13, which is also a moisture barrier, outwardly overlaps the starter flashing strip 15 to bond the lower portion of the starter panel 14 and direct moisture outwardly.

Figure 22:
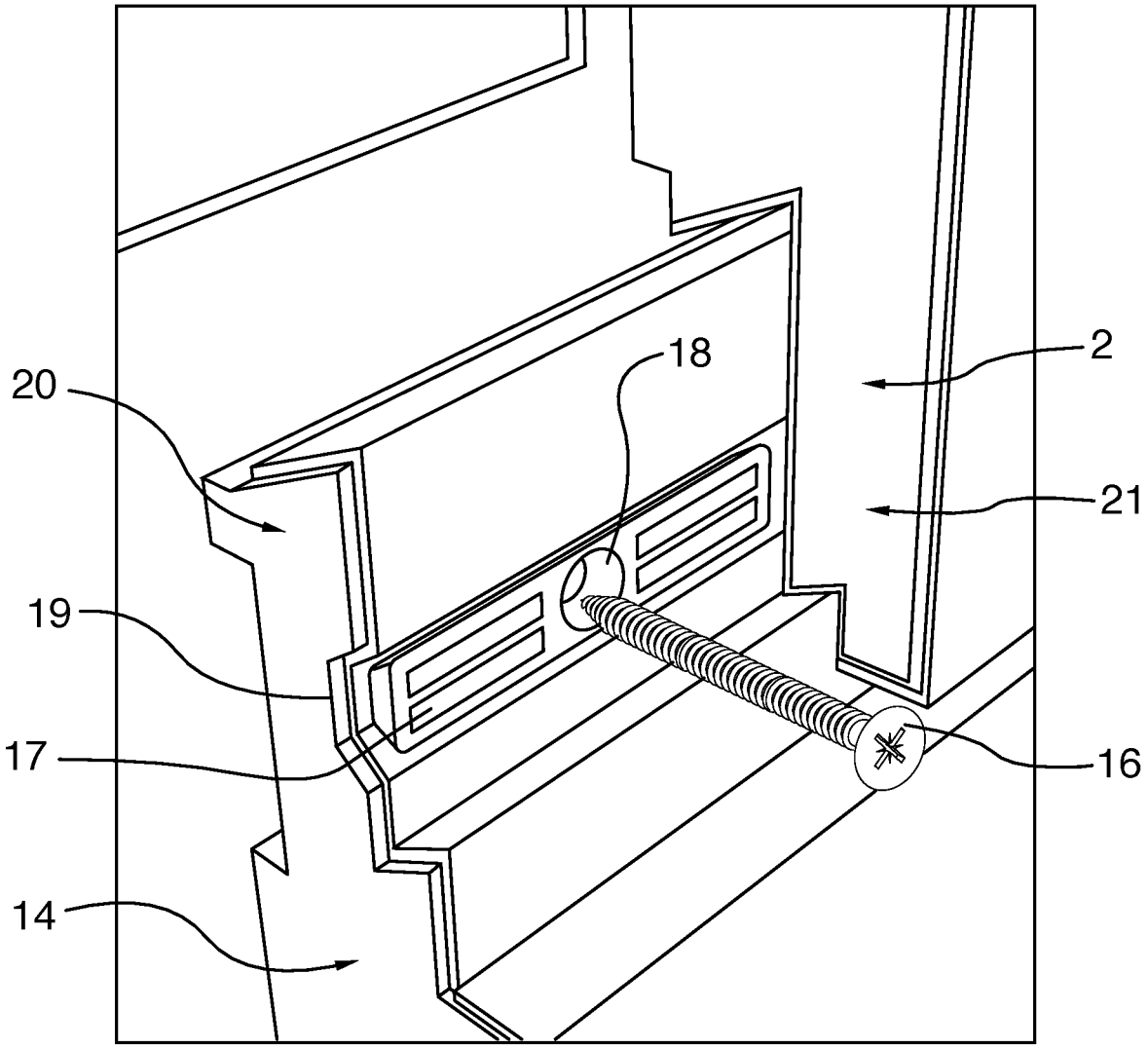
FIG. 22 is a detail of the screw fastener, elongate trapezoidal washer and trapezoidal mounting groove also seen in FIG. 2 middle-left.

As seen in FIGS. 2 and 22, the starter panel 14 and intermediate panels 2 are mounted to the board 3 with adhesive 13 and mechanical fasteners comprising wood screws 16, and an elongate washer 17. As best seen in FIG. 22, the washer 17 includes a countersunk socket 18 to accommodate the head of the screw 16. The washer 17 is trapezoidal and fits into a trapezoidal mounting groove 19. The mechanical fastener arrangement is flush to the mounting flange 20, avoids interference with the overlapping cover flange 26, and distributes the load from the screw 16 over a large area of the mounting groove 19 to avoid crushing damage. The screws 16 and washers 17 secure the panels 2, 14 in place during installation until the adhesive 13 is cured and fully bonded.

Figure 7:
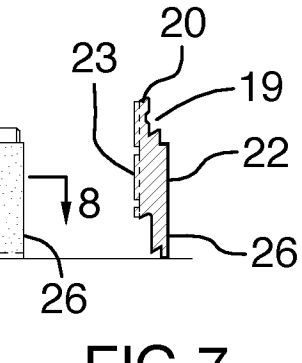
FIG. 7 shows a section view along line 7-7 of FIG. 6.
Figure 6:
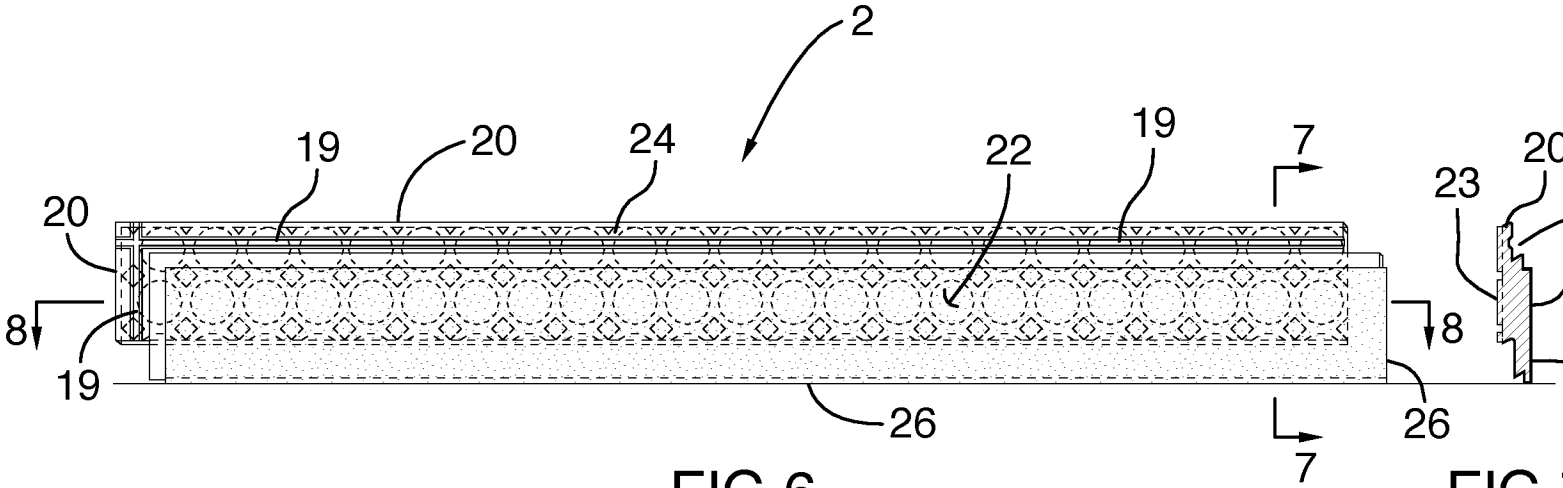
FIG. 6 shows an exterior elevation view of a narrow panel similar to the wide panel of FIGS. 3-5.
Figure 8:
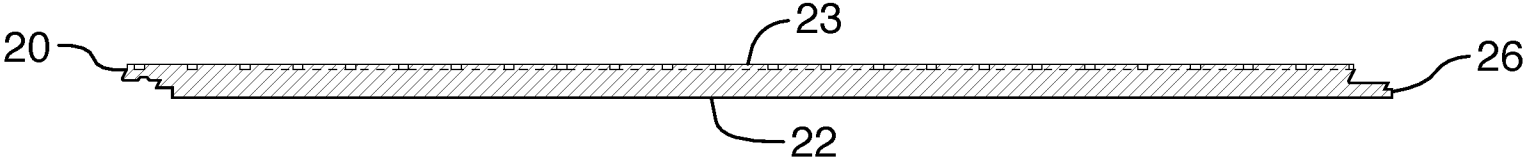
FIG. 8 shows a section view along line 8-8 of FIG. 6.
Figure 10:
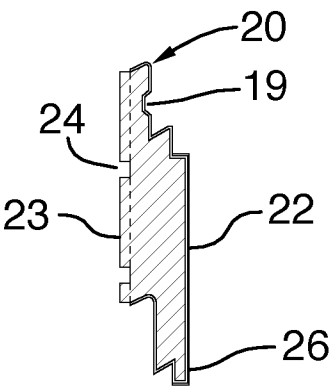
FIG. 10 shows a section view along line 10-10 of FIG. 9.

FIGS. 3-5 show a wide version of the panel 2, whereas FIGS. 6-8 show a narrow version which is identical in all respects except for the width of the panel. The panels 2 can be installed horizontally as in FIG. 1 or vertically, and wide and narrow panels 2 can be installed in alternating rows to achieve various visual effects.

It is common practice in manufacturing insulating foam panels and trim members to cut the various foam core shapes from a large foam block using a CNC controlled hot wire cutter. The foam core has a uniform cross-sectional profile as a result of the hot wire path carved through the foam block. In order to produce the shapes shown in FIGS. 3-5 and 6-8, two stages of hot wire cutting are required. For example, in a first stage the hot wire operates longitudinally and cuts the cross-sectional profile shown in FIGS. 4 and 7. In a second stage, the hot wire operates transversely and cuts the left and right edges to achieve the cross-sectional profile as shown in FIGS. 5 and 8.

Figure 9:
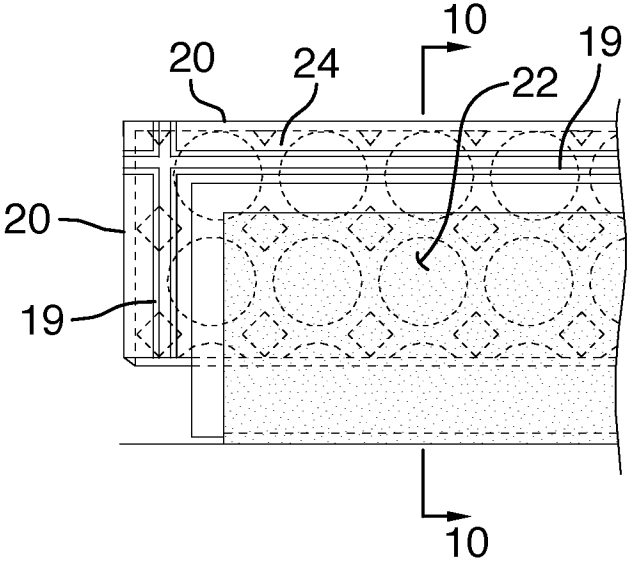
FIG. 9 shows a detail view of the left portion of the narrow panel of FIG. 6.

Each panel 2 has an insulation foam core and weather resistant coating which can include a reinforcing mesh layer and multiple coats of cementitious or non-cementitious materials. Various surface effects can be applied to the exposed outside surface 22 such as colors, surface textures and granules. The generally rectangular panels 2 have a central portion with a uniform panel thickness between the inside mounting surface 23 and the exposed outside surface 22. In FIGS. 3, 6 and 9 the dashed lines indicate that the inside mounting surface 23 includes drainage grooves 24 formed in circular shapes by removing foam material with a rotating cutter for example. The drainage grooves 24 are also visible in FIGS. 11-21 and provide a drainage path for any trapped moisture to escape by flowing downward under gravity. The top edge, bottom edge, and opposing lateral edges are profiled to interlock and overlap the edges as shown in FIG. 12 for example.

When installed (FIG. 1-2 for example) the panels 2, 14 are arranged in a series of parallel vertical rows, parallel horizontal rows or in other patterns such as herringbone. As seen in FIGS. 3 and 6, each panel 2 has a mounting flange 20 disposed on the top edge and on one lateral edge. In the embodiments shown in the drawings, the mounting flange 20 is on the left edge but it could be located on the right edge to equal effect. The mounting flange 20 includes a recessed mounting groove 19 (see FIG. 22) to retain the elongate trapezoidal washer 17 and mounting screws 16.

Figure 11:
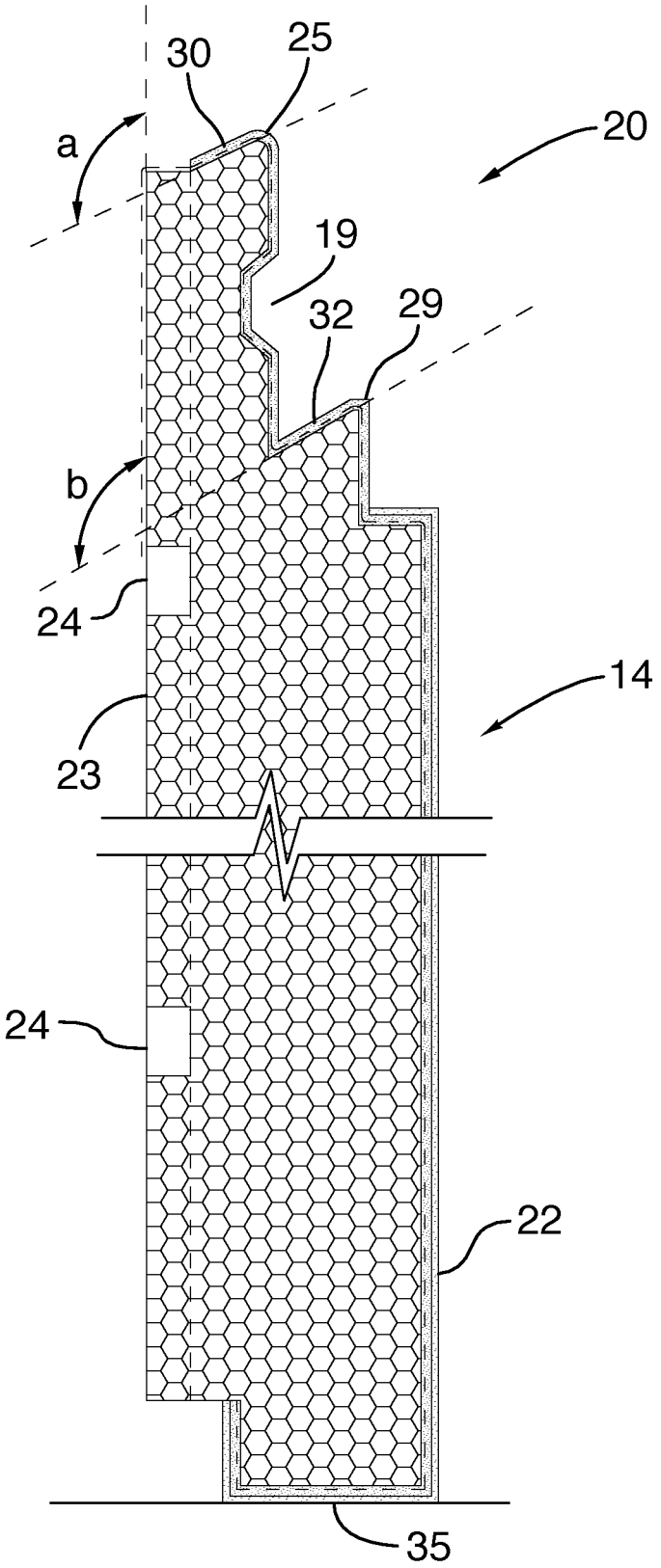
FIG. 11 shows a sectional view through a starter panel also shown as the first row of panels in FIG. 2.
Figure 12:
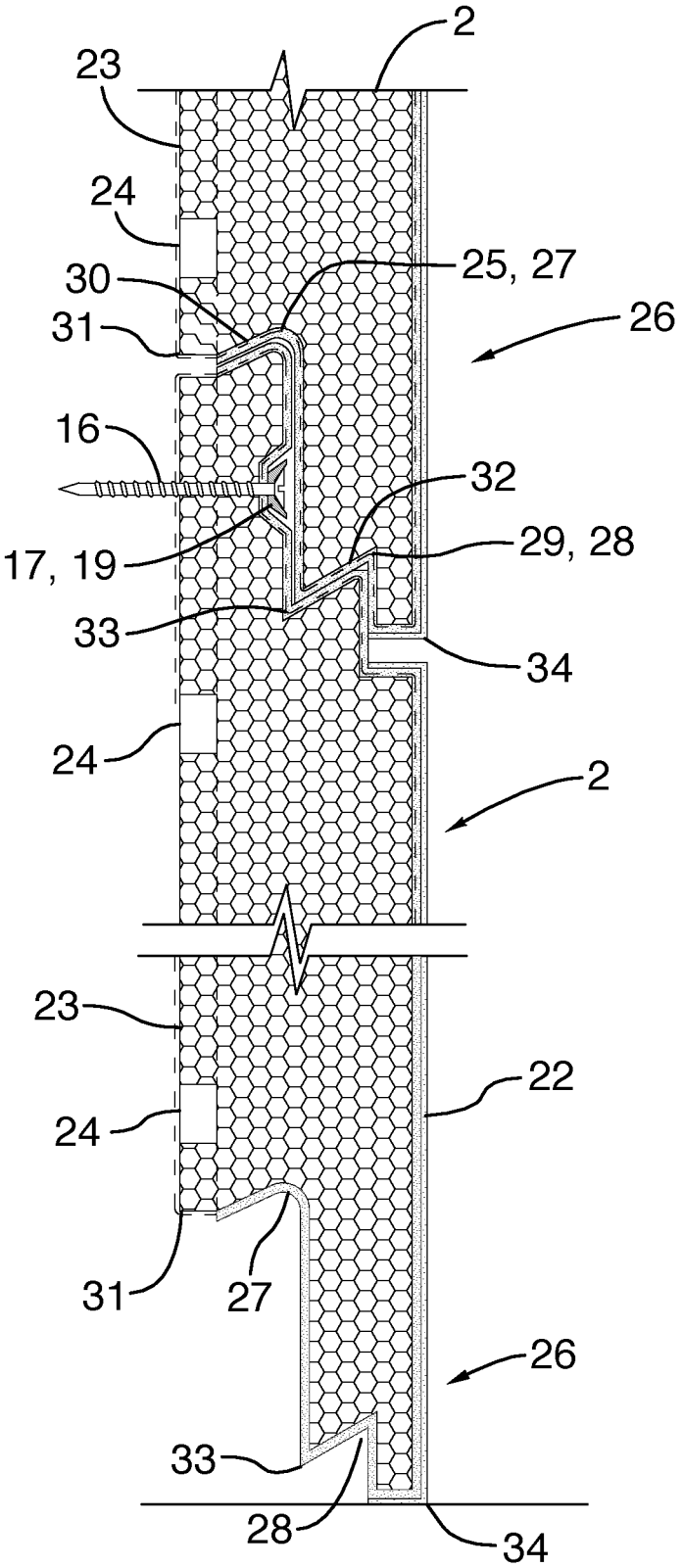
FIG. 12 shows a sectional view through a regular or intermediate panel and a partial broken section of an interlocking and overlapping panel above.

As seen in FIGS. 11-12, the mounting flange 20 includes an inner ridge 25 and an outer ridge 29 which serve to wedge interlock with the bottom edge of a row of panels 2 subsequently installed from above. The elongate cover flange 26 is complementary in cross-sectional profile shape with the mounting flange 20. The cover flange 26 in the embodiments shown is disposed on the bottom edge and on the right lateral edge to engage the opposing left lateral edge of an adjacent panel 2. As seen in FIG. 12, the cover flange 26 includes an inner groove 27 complementary to the inner ridge 25, and an outer groove 28 complementary to the outer ridge 29.

The mechanical fastener screws 16 have a fastener head that is countersunk within the elongate washer 17 within the recessed mounting groove 19 and a helical screw shank for anchoring in the supporting oriented strand board 3. As indicated in FIG. 12, the screw head and washer 17 are flush mounted within the mounting groove 19 and do not interfere with the sliding insertion of the cover flange 26. It will be understood that the same use of screws 16 and washers 17 occurs on the lateral edges that have mounting grooves 19 as well.

The ridges 25, 29, the grooves 19, 27, 28 and the exterior exposed surface 22 of each panel is coated with weatherproof materials. Wind forces on a building can include pressure differentials that create a vacuum that tends to draw moisture into any joints or cracks in the exposed surface. Further, capillary action can draw moisture from the surface into joints. The tight wedging fit of the interlocking ridges 25, 29, and grooves 27, 28, the weatherproof coating of joint surfaces, the moisture barrier 12 and drainage grooves 24 serve to resist migration of moisture through the joints and to drain away any moisture from the inside mounting surface 23 of the panels 2.

The wedge interlocking of ridges 25, 29, and grooves 27, 28 is sufficient to secure the cover flange 26 without using adhesives or caulking in the joint. Referring to FIGS. 11-12 the inner ridge 25 has an inner detent surface 30 to engage and abut the inner groove 27. The inner detent surface 30 is disposed at an obtuse angle "a" relative to the inside mounting surface 23. Referring to FIG. 12, the cover flange 26 includes an inward wedge 31 defined between the inside mounting surface 23 and the inner groove 27. When the upper row of panels 2 is installed in a downward sliding motion, the inward wedge 31 is wedged between the supporting board 3 and the sloped inner detent surface 30 of the previously installed lower panel 2.

In a similar manner, the outer ridge 29 has an outer detent surface 32 to abut the outer groove 28. The outer detent surface 32 is disposed at a second obtuse angle "b" (FIG. 11) relative to the inside mounting surface 23 of the panel 2. The cover flange 26 provides an outward wedge 33 (FIG. 12) defined between the outer groove 28 and the inner groove 27. The outer wedge 33 engages the sloped outer detent surface 32 and exerts a force driving the cover flange 26 toward the adhesive 13 and wall board 3.

The wedging forces exerted by the interaction of the sloped detent surfaces 30, 32 and the wedges 31, 33 drives the cover flange 26 inwardly to ensure that the adhesive 13 bonds sufficiently to the inside mounting surface 23 of each panel 2. The screws 16 secure the mounting flange 20 even if adhesive remains fluid and prevent the inward wedge 31 from prying the mounting flange outward away from the board 3.

Referring to FIG. 12, the cover flange 26 includes a flap 34 defined between the outer groove 28 and the exposed outside surface 22 of the panel 2. In the embodiment shown, the flap 34 provides a drip edge and is spaced from the panel 2 below to provide a visual reveal feature. The flap 34 could also be extended downward to eliminate the reveal and abut the panel 2 below. For example, the reveal can be eliminated in points on the lateral edges of adjacent panels 2 in the same row.

Referring to FIG. 13, the installation of the panel system commences with the installation of the PVC starter flashing strip 15. As seen in FIG. 11, the row of starter panels 14 is then installed using the same mounting flange 20 disposed on the top edge and side edge using the recessed mounting groove 19, washers 17 and screws 16. The starter panels 14 have no other panels below and instead have a drip flange 35 disposed on the bottom edge. As shown in FIG. 13, the starter flashing strip 15 in the installation is hidden in a groove inward of the drip flange 35 between an inside mounting surface 23 of the starter panel 14 and the supporting structural board 3.

Figure 14:
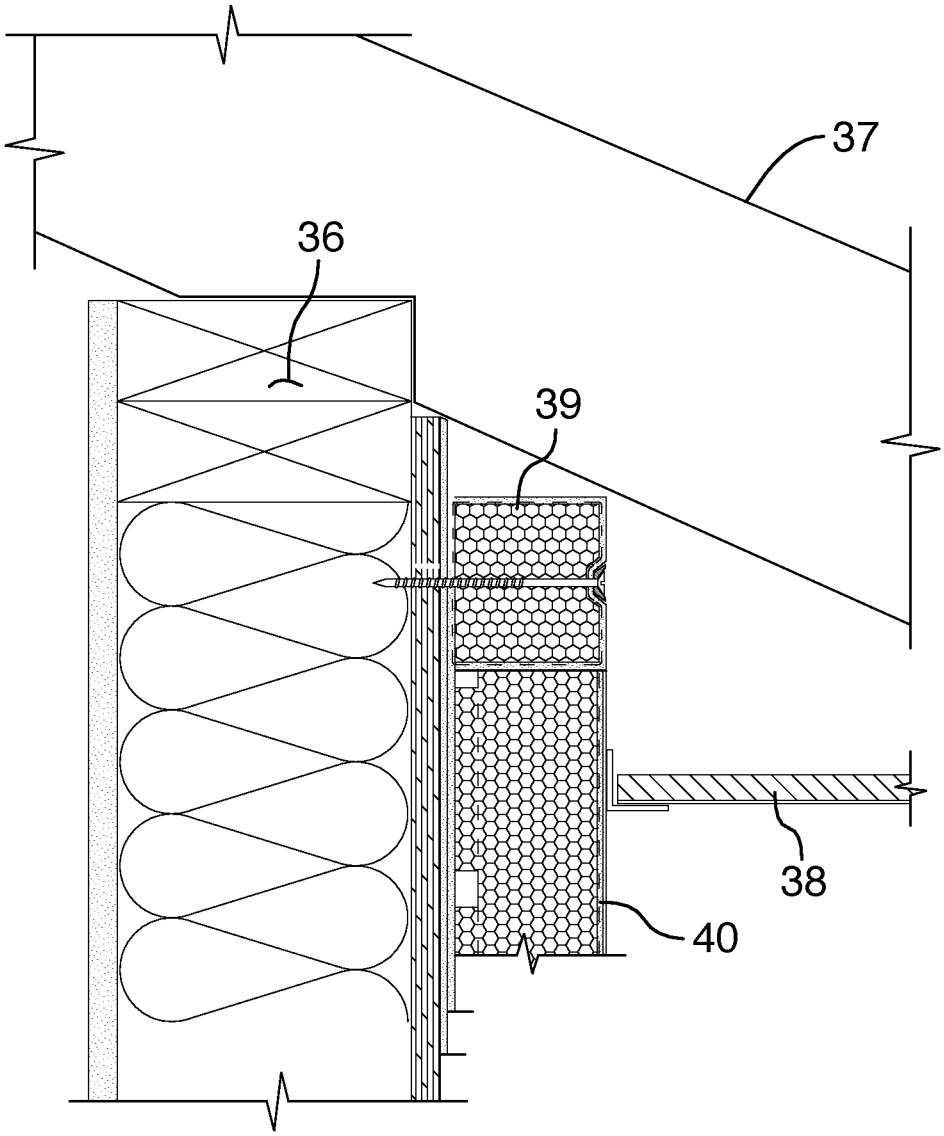
FIG. 14 is a partial vertical section view through the upper wall, eaves and rafter portion of an exterior building structure showing a square framing strip and abutting top panel joined above the soffit.

FIG. 14 shows partial vertical section view through the exterior wall top plate 36, roof rafter 37 and soffit 38. The insulated cladding system includes a square framing strip 39 and abutting square ended top panel 40 that have a joint 38 above the soffit 38. Like the panels 2, 14 and 40 the framing strip 39 has an insulation core and weather resistant coating. The framing strip 39 has a thickness equal to the thickness of the panel 40, and provides an abutment surface to secure the top edge of the top panel 40. The top panel 40 has a rectangular abutment flange on the top edge for abutting the top finishing strip 39. The top edge may be pre-finished during manufacturing if the wall height is known in advance or may be trimmed on site having a raw uncoated foam top edge as a result. The top panel 40 has the same elongate cover flange 26 complementary with the mounting flange 20 disposed on the bottom edge and on a lateral edge to interlock and overlap a panel 2 below and laterally.

Figure 15:
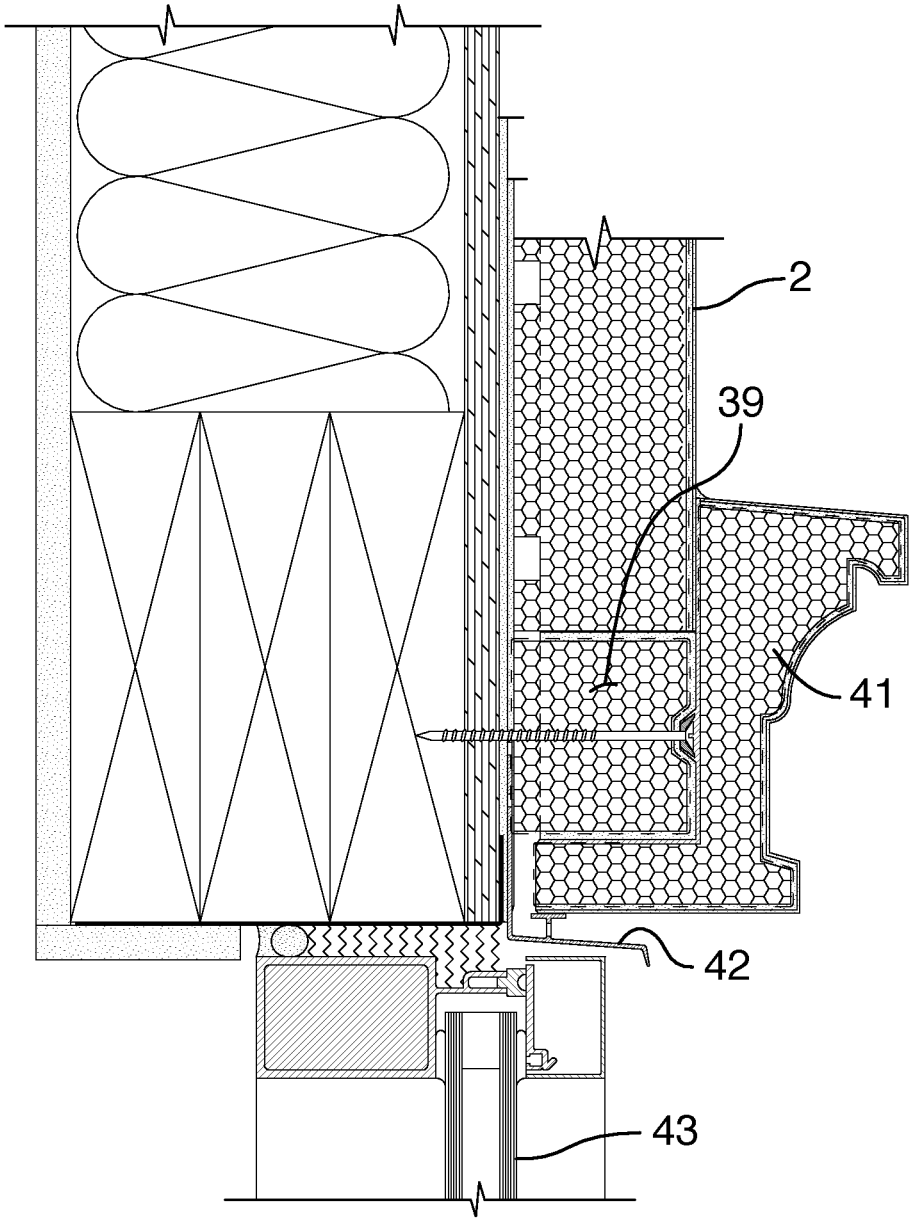
FIG. 15 is a vertical sectional view through a lintel above a window opening showing the EIFS cladding including a decorative molding trim covering a framing strip and the joint of an abutting panel above.
Figure 16:
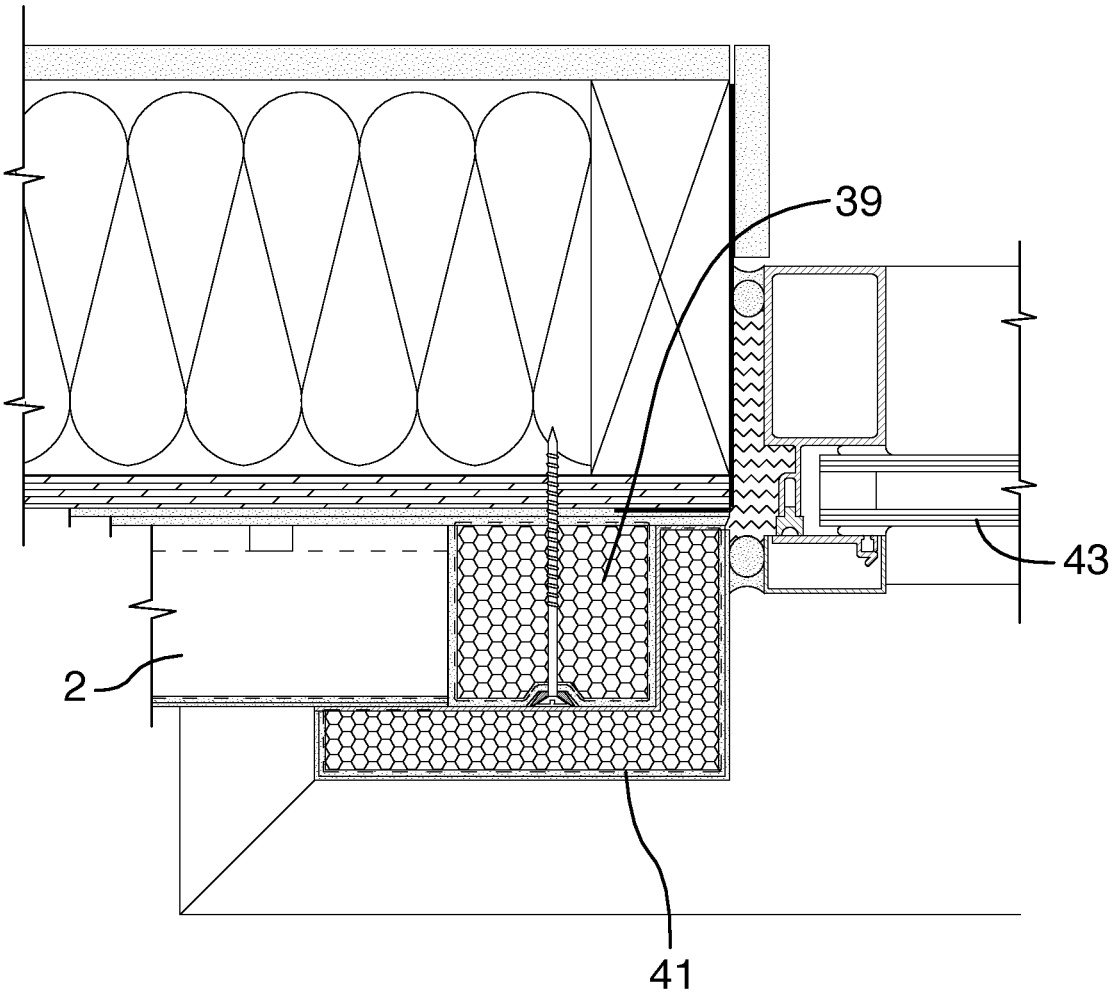
FIG. 16 is a horizontal sectional view through the exterior left jamb of a window opening showing the EIFS cladding including an L-shaped molding trim covering a framing strip and the joint of an abutting panel to the left side.
Figure 17:
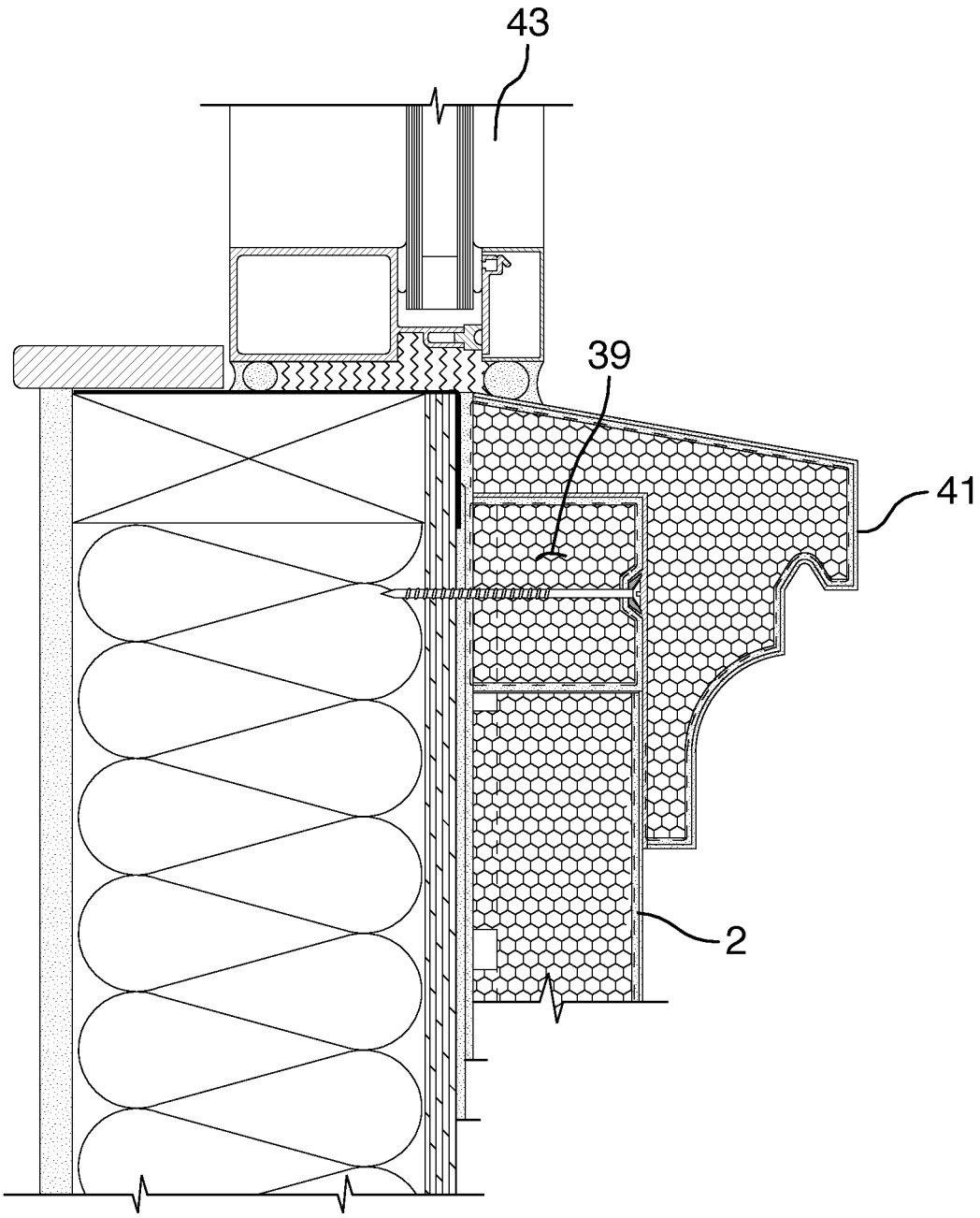
FIG. 17 is a vertical sectional view through a sill below a window opening showing the EIFS cladding including a decorative molding trim covering a framing strip and the joint of an abutting panel below.

As shown in the window framing examples of FIGS. 15-17 a square framing strip 39 is installed around a window or door opening to abut the adjacent panels 2. The framing strip 39 and joint with the panel 2 is covered with a decorative trim molding 41 and drip flashing 42 to surround the window 43.

Figure 18:
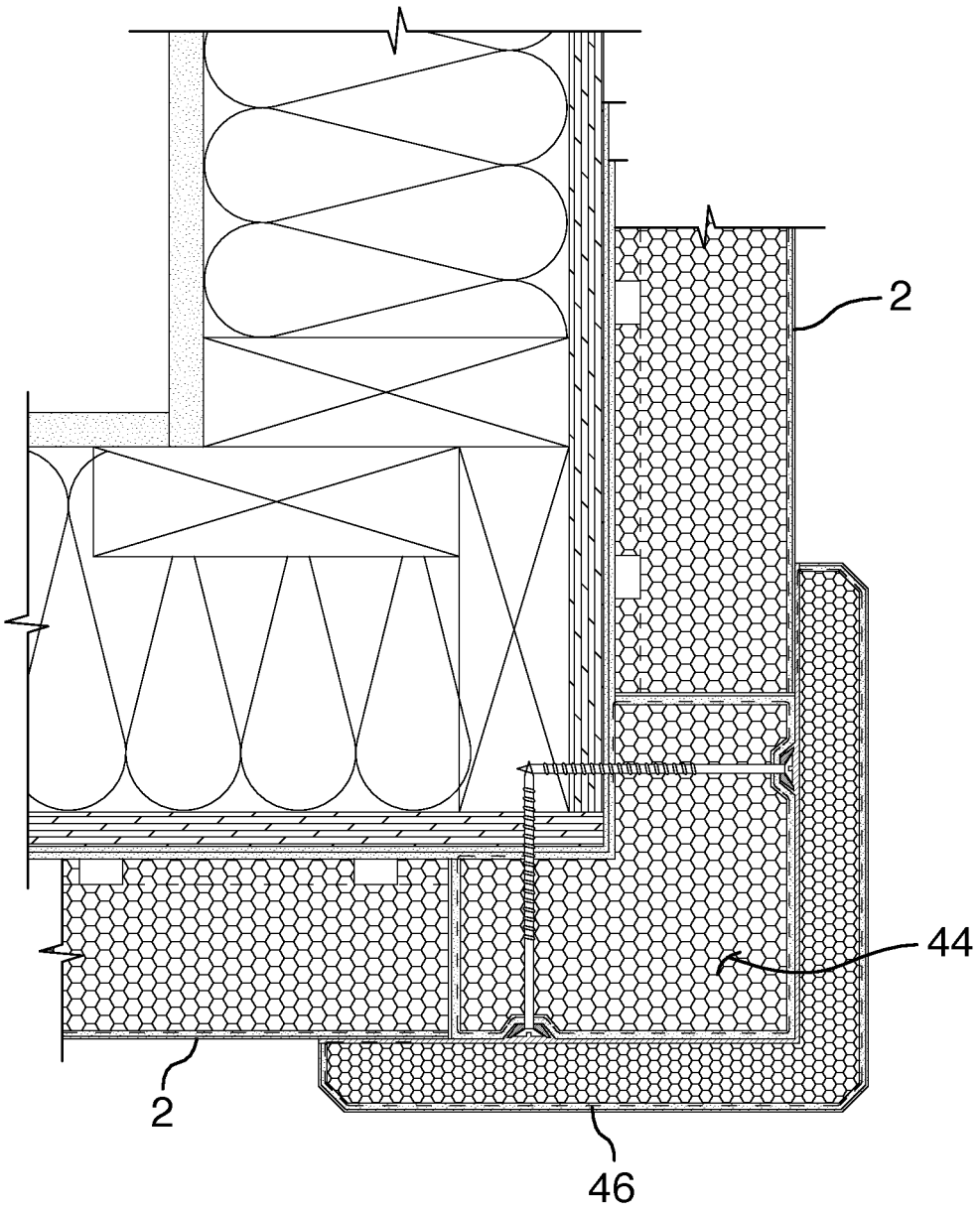
FIG. 18 is a horizontal sectional view through an outside corner showing an L-shaped outside corner strip, abutting panels of equal thickness on both sides of the corner strip, and an L-shaped decorative trim strip covering the outside corner strip and the abutting joints with the panels.
Figure 19:
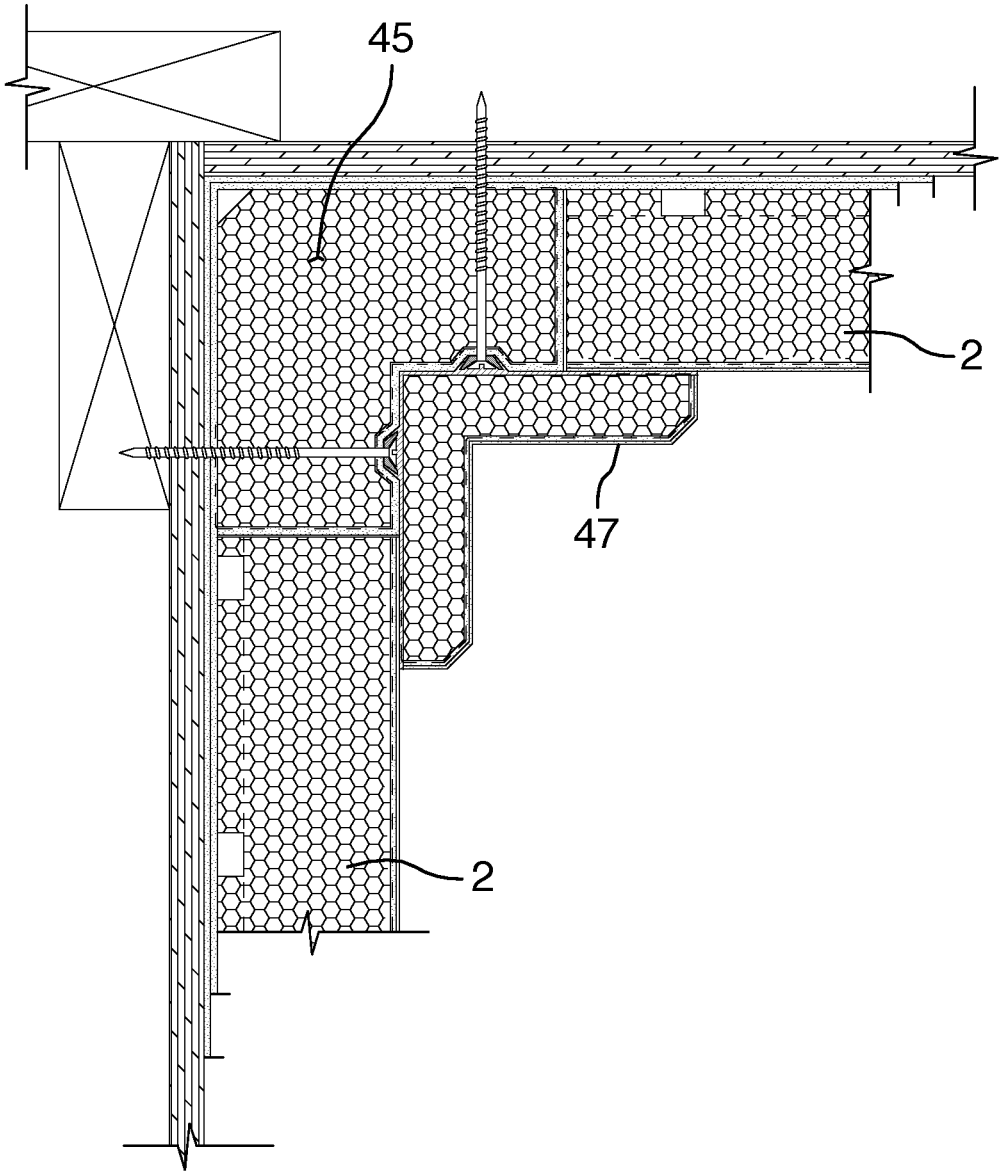
FIG. 19 is a horizontal sectional view through an inside corner showing an L-shaped inside corner strip, abutting panels of equal thickness on both sides of the corner strip, and an L-shaped decorative trim strip covering the inside corner strip and the abutting joints with the panels.

FIGS. 18 and 19 show a first alternative for inside and outside corners. FIG. 1 also illustrates these corner treatments. FIG. 18 shows an L-shaped outside corner strip 44 that provides a vertical abutment for the lateral ends of adjacent panels 2 which have been trimmed on site to a square end. The outside corner strip 44 and joints with the adjacent panels 2 are covered with an L-shaped outside corner trim strip 46. FIG. 19 shows an L-shaped inside corner strip 45 that provides a vertical abutment for the lateral ends of adjacent panels 2 which have been trimmed on site to a square end. The inside corner strip 45 and joints with the adjacent panels 2 are covered with an L-shaped inside corner trim strip 47.

Figure 20:
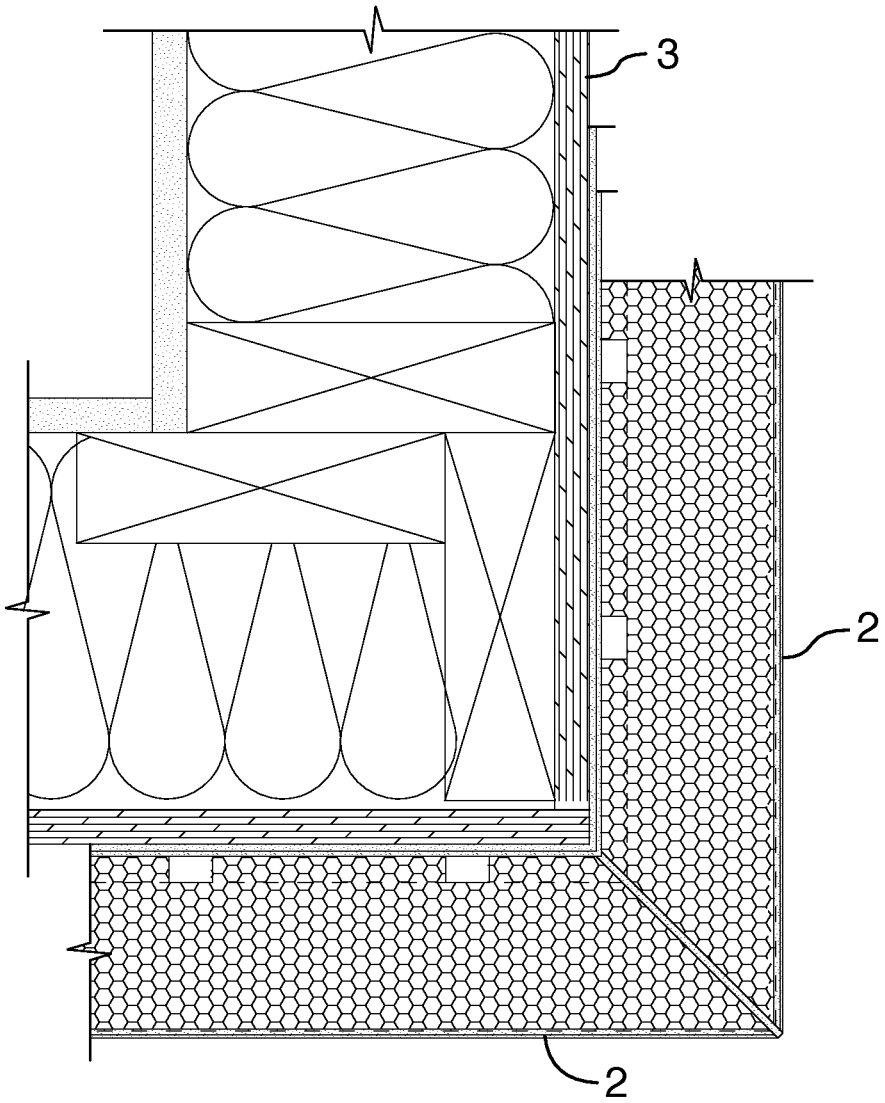
FIGS. 20 and 21 are horizontal section views through an alternative outside and inside corner respectively, where the panels are mitered 45 degrees with the cut surfaces adhered together to produce a simple corner without overlapping components.
Figure 21:
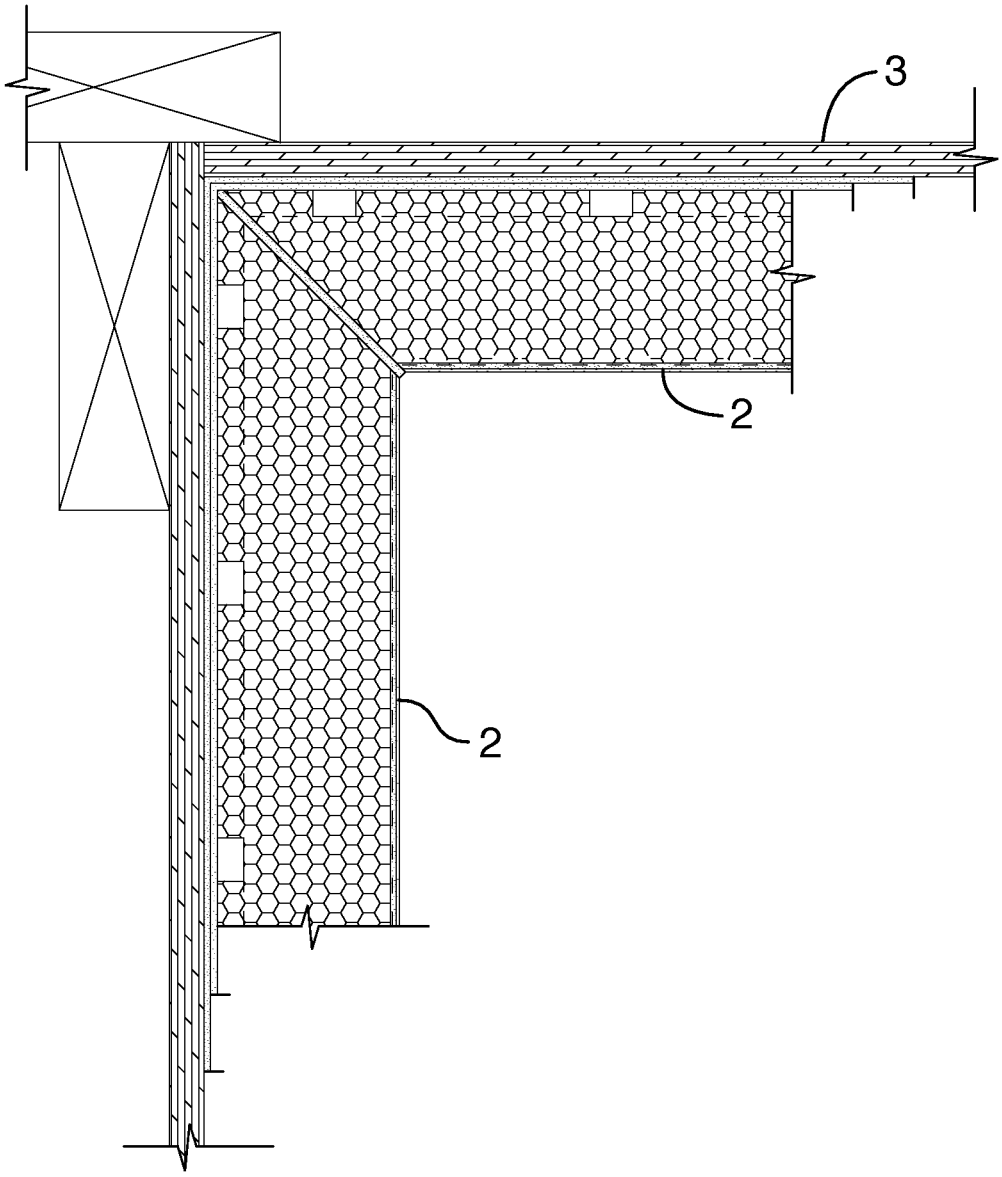

FIGS. 20 and 21 are horizontal section views through an alternative outside and inside corner respectively, where the panels 2 are mitered 45 degrees with the cut surfaces adhered together with sealant to produce a simple corner without overlapping trim strips 46, 47.

Although the above description relates to a specific preferred embodiment as presently contemplated by the inventor, it will be understood that the invention in its broad aspect includes mechanical and functional equivalents of the elements described herein.

We claim:

1. A pre-finished insulated panel system for cladding an exterior wall of a building, the wall including a supporting structural substrate, the system comprising:

a plurality of rectangular panels, wherein each panel has an insulation core and weather resistant coating defining a central portion with a panel thickness between an inside mounting surface and an exposed outside surface, a top edge, a bottom edge, and opposing lateral edges, the plurality of panels adapted for engagement in a series of parallel rows;

each panel having:

a mounting flange disposed on the top edge and on a first lateral edge of each panel, the mounting flange including: a recessed mounting groove; an inner ridge; and an outer ridge;

an elongate cover flange complementary with the mounting flange disposed on the bottom edge and on an opposing second lateral edge, the cover flange including: an inner groove complementary to the inner ridge; and an outer groove complementary to the outer ridge; and mechanical fasteners having a fastener head disposed within the recessed mounting groove and a shank for anchoring in the supporting structural substrate;

wherein the inner ridge has an inner detent surface to abut the inner groove;

wherein the inner detent surface is disposed at a first obtuse angle relative to the inside mounting surface;

wherein the cover flange includes an inward wedge defined between the inside mounting surface and the inner groove;

wherein the inner detent surface and inward wedge are configured to interact for exerting a force driving the cover flange toward the supporting structural substrate.

2. The system according to claim 1 wherein the outer ridge has an outer detent surface to abut the outer groove.

3. The system according to claim 2 wherein the outer detent surface is disposed at a second obtuse angle relative to the inside mounting surface of the panel.

4. The system according to claim 3 wherein the cover flange includes an outward wedge defined between the outer groove and the inner groove.

5. The system according to claim 4, wherein the outward detent surface and outward wedge are configured to interact for exerting a force driving the cover flange toward the supporting structural substrate.

6. The system according to claim 1 wherein the cover flange includes a flap defined between the outer groove and the exposed outside surface of the panel.

7. The system according to claim 1 comprising an elongate washer disposed between the fastener head and the recessed mounting groove.

8. The system according to claim 7 wherein the recessed mounting groove and elongate washer have complementary trapezoidal profiles.

9. The system according to claim 1 including an adhesive coating adjacent to the inside mounting surface of each panel.

10. The system according to claim 9 wherein a moisture barrier coating is disposed inward of the adhesive coating.

11. The system according to claim 1 wherein the inside mounting surface of each panel includes moisture drainage grooves.

12. The system according to claim 1 including a framing strip having an insulation core and weather resistant coating between an inside mounting surface and an exposed outside surface, the framing strip having a strip thickness equal to the panel thickness.

13. The system according to claim 12 wherein the framing strip is one of: an L-shaped inside corner strip; an L-shaped outside corner strip; and a rectangular opening framing strip.

14. The system according to claim 13 including a top panel having:

a rectangular abutment flange on the top edge of the top panel for abutting the top finishing strip;

a mounting flange disposed on a first lateral edge of each top panel, the mounting flange including: a recessed mounting groove; an inner ridge; and an outer ridge;

an elongate cover flange complementary with the mounting flange disposed on the bottom edge and on an opposing second lateral edge, the cover flange including: an inner groove complementary to the inner ridge; and an outer groove complementary to the outer ridge.

15. The system according to claim 1 including a starter panel having:

a mounting flange disposed on a top edge and on a first lateral edge of each starter panel, the mounting flange including: a recessed mounting groove; an inner ridge; and an outer ridge; and a drip flange disposed on the bottom edge.

16. The system according to claim 15 including a starter flashing strip for installation inward of the drip flange between an inside mounting surface of the starter panel and the supporting structural substrate of the wall.

* * * * *